US010134327B2

(12) United States Patent
Park et al.

(10) Patent No.: US 10,134,327 B2
(45) Date of Patent: Nov. 20, 2018

(54) NON-QUADRANGULAR DISPLAY PANEL

(71) Applicant: SAMSUNG DISPLAY CO., LTD., Yongin-si, Gyeonggi-Do (KR)

(72) Inventors: Hyun Ae Park, Cheonan-si (KR); Byoung Sun Kim, Hwaseong-si (KR)

(73) Assignee: SAMSUNG DISPLAY CO., LTD., Yongin-si, Gyeonggi-do (KR)

( * ) Notice: Subject to any disclaimer, the term of this patent is extended or adjusted under 35 U.S.C. 154(b) by 241 days.

(21) Appl. No.: 14/973,773

(22) Filed: Dec. 18, 2015

(65) Prior Publication Data

US 2016/0335982 A1 Nov. 17, 2016

(30) Foreign Application Priority Data

May 11, 2015 (KR) ..... 10-2015-0065448

(51) Int. Cl.
*G09G 3/20* (2006.01)

(52) U.S. Cl.
CPC ..... *G09G 3/2092* (2013.01); *G09G 3/20* (2013.01); *G09G 2300/0426* (2013.01); *G09G 2310/0275* (2013.01); *G09G 2310/0297* (2013.01)

(58) Field of Classification Search
CPC .. G09G 3/2092; G09G 3/2096; G09G 3/3266; G09G 3/3275
See application file for complete search history.

(56) References Cited

U.S. PATENT DOCUMENTS

| | | | | |
|---|---|---|---|---|
| 7,375,709 | B2 * | 5/2008 | Toriumi | G09G 3/3688 345/100 |
| 7,375,716 | B2 * | 5/2008 | Toriumi | G09G 3/3688 345/100 |
| 2008/0266210 | A1 * | 10/2008 | Nonaka | G09G 3/20 345/55 |
| 2009/0195721 | A1 | 8/2009 | Tanahara | |
| 2010/0141874 | A1 | 6/2010 | Morita | |
| 2012/0134120 | A1 | 5/2012 | Gondo | |
| 2014/0215426 | A1 | 7/2014 | He et al. | |
| 2016/0232837 | A1 * | 8/2016 | Lee | G09G 3/3688 |

FOREIGN PATENT DOCUMENTS

JP 2006-276359 10/2006

* cited by examiner

*Primary Examiner* — Gene W Lee
(74) *Attorney, Agent, or Firm* — F. Chau & Associates, LLC

(57) ABSTRACT

A non-quadrangular display panel includes a plurality of first signal lines disposed in a non-quadrangular display area, wherein the non-quadrangular display area includes a plurality of pixels. A switching circuit is disposed in a peripheral area of the non-quadrangular display panel. The peripheral area is disposed adjacent to the non-quadrangular display area. The switching circuit passes a signal to at least one of the plurality of first signal lines. A plurality of second signal lines is disposed in the peripheral area. At least two adjacent second signal lines are uniformly spaced apart from each other and transmit signals at different times to the switching circuit. A plurality of third signal lines is disposed in the peripheral area orthogonal to the plurality of second signal lines and connected to the switching circuit.

18 Claims, 7 Drawing Sheets

NON-QUADRANGULAR DISPLAY PANEL

CROSS-REFERENCE TO RELATED APPLICATION

This application claims priority under 35 U.S.C. § 119 to Korean Patent Application No. 10-2015-0065448, filed on May 11, 2015, in the Korean Intellectual Property Office, the disclosure of which is incorporated by reference herein in its entirety.

TECHNICAL FIELD

Exemplary embodiments of the present invention relate to a non-quadrangular display panel.

DISCUSSION OF THE RELATED ART

A plurality of pixels and signal lines are formed on a display panel configuring a display. Conventionally, a plurality of signal lines include a scan line extending in a first direction and a data line extending in a second direction that is perpendicular to the first direction.

A demultiplexer may be formed on one side of a non-display area provided near a display area. The demultiplexer uses a clock signal and a signal applied by a driver integrated circuit (IC) connected to a display panel to apply a data signal to a data line.

The driver IC is connected to the demultiplexer through data fanout wires disposed on the display panel. A clock signal wire for transmitting the clock signal and the fanout wires are disposed in a peripheral area of the display area. The fanout wires formed near the demultiplexer extend in parallel in a first direction and the clock signal wires extend in parallel in a second direction, so the fanout wires and the clock signal wires overlap each other.

Resistance and capacitance are generated by the overlapping of the wires. In the case of a quadrangular display panel, the fanout wires and the clock signal wires overlap each other substantially orthogonally so areas of the overlapped regions are substantially the same. Therefore, resistance and capacitance formed by the overlapped regions are substantially the same.

In the case of a display panel having an arbitrary shape, the areas or forms in which the clock signal wires and the fanout wires overlap are not predetermined. Accordingly, resistance and capacitance formed by the overlapped regions are different from each other.

SUMMARY

According to an exemplary embodiment of the present invention, a non-quadrangular display panel includes a plurality of first signal lines disposed in a non-quadrangular display area. The non-quadrangular display area includes a plurality of pixels. A switching circuit is disposed in a peripheral area of the non-quadrangular display panel. The peripheral area is disposed adjacent to the non-quadrangular display area. The switching circuit passes a signal to at least one of the plurality of first signal lines. A plurality of second signal lines is disposed in the peripheral area. At least two adjacent second signal lines are uniformly spaced apart from each other. The plurality of second signal lines transmit signals at different times to the switching circuit. A plurality of third signal lines is disposed in the peripheral area orthogonal to the plurality of second signal lines and connected to the switching circuit.

In an exemplary embodiment of the present invention, the non-quadrangular display area is circular.

In an exemplary embodiment of the present invention, the plurality of first signal lines and the plurality of third signal lines are disposed on a first layer.

In an exemplary embodiment of the present invention, the plurality of second signal lines are disposed on a second layer.

In an exemplary embodiment of the present invention, an insulating layer is disposed between the first and second layers.

In an exemplary embodiment of the present invention, the non-quadrangular display panel further includes a driver integrated circuit (IC) connected to the plurality of third signal lines, and generating the signal passed to the at least one of the plurality of first signal lines.

In an exemplary embodiment of the present invention, the switching circuit includes a switching element including input terminals connected to the plurality of third signal lines, output terminals connected to the plurality of first signal lines, and gate terminals connected to the plurality of second signal lines.

In an exemplary embodiment of the present invention, a first area of a first region in which a second signal line of the plurality of second signal lines overlaps with a third signal line of the plurality of third signal lines is substantially equal to a second area of a second region in which the second signal line of the plurality of second signal lines overlaps with another third signal line of the plurality of third signal lines.

In an exemplary embodiment of the present invention, imaginary lines extending from the plurality of third signal lines meet at a point in the non-quadrangular display area.

According to an exemplary embodiment of the present invention, non-quadrangular display panel includes a plurality of first signal lines disposed in a non-quadrangular display area. A plurality of second signal lines are curved and disposed in a peripheral area. The peripheral area is disposed adjacent to the non-quadrangular display area. At least two adjacent second signal lines of the plurality of second signal lines are uniformly spaced apart from each other. A plurality of third signal lines is disposed in the peripheral area. Each third signal line of the plurality of third signal lines crosses at least one second signal line of the plurality of second signal lines at a perpendicular angle. The plurality of first signal lines, the plurality of second signal lines, and the plurality of third signal lines are connected to a switching circuit. The switching circuit passes a signal from one of the plurality of third signal lines to a first pixel through a first signal line of plurality of first signal lines.

In an exemplary embodiment of the present invention, the plurality of second signal lines are circular.

In an exemplary embodiment of the present invention, the plurality of second signal lines are oval.

In an exemplary embodiment of the present invention, the plurality of second signal lines include a concave portion and a convex portion.

In an exemplary embodiment of the present invention, the plurality of first signal lines and the plurality of third signal lines are disposed on a first layer.

In an exemplary embodiment of the present invention, the plurality of second signal lines are disposed on a second layer.

In an exemplary embodiment of the present invention, an insulating layer is disposed between the first and second layers.

In an exemplary embodiment of the present invention, the non-quadrangular display panel further includes a driver IC connected to the plurality of third signal lines, wherein the driver IC generates the signal passed to the first pixel.

In an exemplary embodiment of the present invention, the switching circuit includes a first switching element. The first switching element includes input terminals connected to the plurality of third signal lines, output terminals connected to the plurality of first signal lines, and gate terminals connected to the plurality of second signal lines.

In an exemplary embodiment of the present invention, a first overlap area between one of the third signal lines and one of the second signal lines is substantially equal to a second overlap area between another third signal line and the one of the second signal lines.

According to an exemplary embodiment of the present invention, a non-quadrangular display panel includes a plurality of first signal lines disposed in a non-quadrangular display area. The peripheral area is disposed adjacent to the non-quadrangular display area. At least two adjacent second signal lines of the plurality of second signal lines are uniformly spaced apart from each other. A plurality of third signal lines is disposed in the peripheral area and crosses the plurality of second signal lines substantially orthogonally. The plurality of first signal lines, the plurality of second signal lines, and the plurality of third signal lines are connected to a switching circuit. The switching circuit passes a signal from one of the plurality of third signal lines to a first pixel through a first signal line of plurality of first signal lines. Imaginary lines extending from the plurality of third signal lines meet at a point in the non-quadrangular display area.

DETAILED DESCRIPTION OF THE EMBODIMENTS

Figure 1:
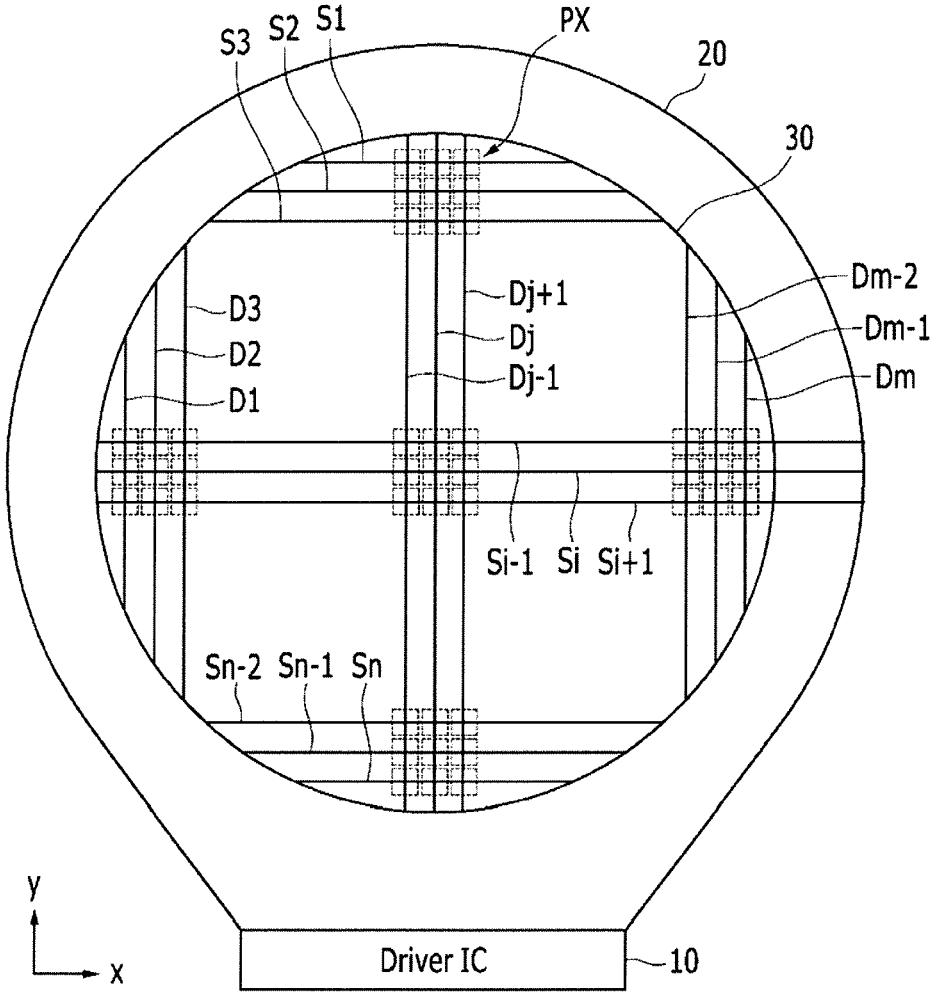
FIG. 1 shows a non-quadrangular display panel, according to an exemplary embodiment of the present invention.

Hereinafter, exemplary embodiments of the present invention will be described in detail with reference to the accompanying drawings. In the present disclosure, the same or similar components may be denoted by the same or similar reference numerals. The accompanying drawings are provided to illustrate exemplary embodiments of the present invention and are not to be interpreted as limiting the spirit and scope of the present invention thereto. It is to be understood that the present invention includes all modifications, equivalents, and substitutions that can be made to the disclosed exemplary embodiments without departing from the spirit and scope of the present invention.

It is to be understood that when one component is referred to as being "connected" or "coupled" to another component, it may be directly connected or coupled to the other component or intervening components may be connected therebetween.

Singular forms may include plural forms unless the context clearly indicates otherwise.

FIG. 1 shows a non-quadrangular display panel, according to an exemplary embodiment of the present invention. As shown in FIG. 1, a plurality of first signal lines D1 to Dm, a plurality of second signal lines S1 to Sn, and a plurality of pixels PX disposed in a region in which the first signal lines D1 to Dm cross the second signal lines S1 to Sn, are disposed on a non-quadrangular display panel 20.

A driver integrated circuit (IC) 10 for generating signals on corresponding signal lines disposed on the non-quadrangular display panel 20 may be disposed on a side of the non-quadrangular display panel 20. The driver IC 10 generates a plurality of scan signals that are supplied to the second signal lines S1 to Sn, and generates a plurality of data signals that are supplied to the first signal lines D1 to Dm. The second signal lines S1 to Sn and the first signal lines D1 to Dm are connected to the pixels PX disposed in a non-quadrangular display area 30.

The non-quadrangular display panel 20 may have a predetermined shape that is not quadrangular (e.g., a circle, an oval, a polygon, a polygon having a part which is curved, or a polygon other than a quadrangle). In an exemplary embodiment of the present invention, the non-quadrangular display panel 20 has a shape having a curved portion (e.g., a portion of the perimeter of the non-quadrangular display panel 20 is curved).

The non-quadrangular display panel 20 may be flexible. The non-quadrangular display panel 20 may also be curved, or may have an outer perimeter that is partially curved.

Figure 2:
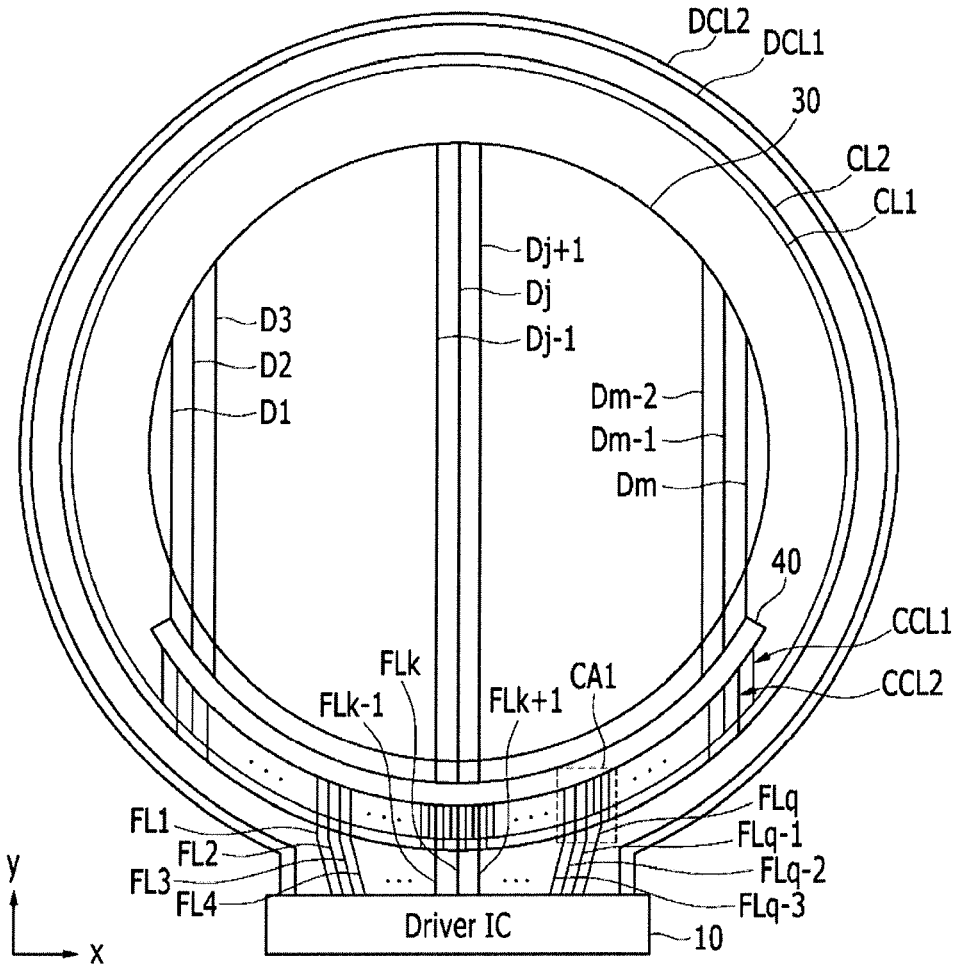
FIG. 2 shows part of a configuration of a non-quadrangular display panel, according to an exemplary embodiment of the present invention.

With reference to FIG. 2, the driver IC 10 outputs a driving signal to a demultiplexer 40 (e.g., a switching circuit). The demultiplexer 40 passes the driving signal to the pixels PX through the first signal lines D1 to Dm and the second signal lines S1 to Sn disposed on the non-quadrangular display panel 20.

The plurality of first signal lines D1 to Dm extend along an y-axis direction, are arranged in an x-axis direction, and are connected to the driver IC 10. The plurality of second signal lines S1 to Sn extend along the x-axis direction, are arranged in the y-axis direction, and are connected to the driver IC 10.

The plurality of pixels PX are connected to corresponding first signal lines, from among the plurality of first signal lines D1 to Dm, and corresponding second signal lines, from among the plurality of second signal lines S1 to Sn. For example, the pixels PX indicated with a plurality of dotted line boxes exemplarily show regions in which the pixels PX may be disposed. However, the present inventive concept is not limited thereto. The plurality of pixels PX may be disposed in various forms in a display area 30 of the non-quadrangular display panel 20.

An additional signal line and the demultiplexer 40 for applying a signal to the first signal lines D1 to Dm will now be described with reference to FIG. 2.

FIG. 2 shows part of a configuration of a non-quadrangular display panel, according to an exemplary embodiment of the present invention. The non-quadrangular display panel 20 includes the display area 30, and a peripheral area bordering the display area 30. In an exemplary embodiment of the present invention, the peripheral area of the non-quadrangular display panel 20 surrounds the display area 30. As shown, clock signal wires CL1 and CL2 and power supply wires DCL1 and DCL2 are disposed in the peripheral area of the non-quadrangular display panel 20, around the display area 30. In an exemplary embodiment of the present invention, the clock signal wires CL1 and CL2 may be disposed in the peripheral area, around the display area 30, and at a distance from the display area 30, and the power supply wires DCL1 and DCL2 may be disposed around the clock signal wires CL1 and CL2 at a distance from the clock signal wires CL1 and CL2. The clock signal wires CL1 and CL2 are disposed in concentric circles at a distance from the display area 30. In an exemplary embodiment of the present invention, when a shape of the display area 30 is not circular but it is curved, elliptical, oval, and the like, the clock signal wires CL1 and CL2 may be equally distant from each other and their shape may be similar to the shape of the display area 30. For example, in an exemplary embodiment of the present invention, when the display area 30 of the non-quadrangular display panel 20 includes a convex portion and a concave portion, the clock signal wires CL1 and CL2 may be shaped to conform to the curvature of the concave and convex portion of the display area 30, the clock signal wires CL1 and CL2 may be disposed at a substantially constant distance away from each other, and the clock signal wires CL1 and CL2 may be disposed at a predetermined distance from the display area 30. In other words, the shape of the clock signal wires CL1 and CL2 depends on the shape of the display area 30.

The clock signal wires include the first clock signal wire CL1 for applying a first clock signal enabled at a first time and the second clock signal wire CL2 for applying a second clock signal enabled at a second time that is different from the first time. The clock signal wires may further include an n-th signal wire for applying an n-th clock signal enabled at a predetermined time that is different from the first time and the second time.

The power supply wires may include a first power supply wire DCL1 for applying a first power source voltage and a second power supply wire DCL2 for applying a second power source voltage. The first power supply wire DCL1 and the second power supply wire DCL2 may supply a power source voltage to the pixels PX.

The plurality of first signal lines D1 to Dm are connected to the demultiplexer 40. The demultiplexer 40 includes a first terminal connected to the first signal lines D1 to Dm, a second terminal connected to the driver IC 10, and switching elements including gates connected to the clock signal wires CL1 and CL2. The switching elements may be turned on by the clock signal supplied to the clock signal wires CL1 and CL2 to pass the signals supplied by the driver IC 10 to the first signal lines D1 to Dm.

The driver IC 10 is disposed in the peripheral area. The driver IC 10 is connected to the demultiplexer 40 through fanout wires FL1 to FLq. The driver IC 10 may be mounted in the peripheral area of the display panel 20 as a chip-on-glass (COG) type. The fanout wires FL1 to FLq may be connected to the driver IC 10 through a pad. The driver IC 10 may include a data driver for supplying a data signal.

The fanout wires FL1 to FLq and the first signal lines D1 to Dm may be disposed on a first layer. The clock signal wires CL1 and CL2 may be disposed on a second layer that is different from the first layer. The first layer may be disposed on the second layer and an insulating layer may be provided between the first layer and the second layer. Alternately, the second layer may be disposed on the first layer and an insulating layer may be provided between the first layer and the second layer.

The fanout wires FL1 to FLq are disposed in an inverse trapezoidal form near the driver IC 10. The fanout wires FL1 to FLq, disposed in an inverse trapezoidal form, extend in the y-axis direction and are connected to the demultiplexer 40 and to the driver IC 10. The fanout wires FL1 to FLq extending in the y-axis direction and the clock signal wires CL1 and CL2 are disposed on different layers and overlap each other.

In an exemplary embodiment of the present invention, the clock signal wires CL1 and CL2 may be disposed along the circumference of the non-quadrangular display area 30. In an exemplary embodiment of the present invention, with reference to FIG. 2, the clock signal wires CL1 and CL2 are circularly disposed in the peripheral area, at a distance from display area 30. The fanout wires FL1 to FLq extend in the y-axis direction and are arranged in the x-axis direction. The fanout wires FL1 to FLq overlap the clock signal wires CL1 and CL2 in different regions of the peripheral area.

For example, fanout wires FLk−1 to FLk+1 overlap the clock signal wires CL1 and CL2 in a center region of the peripheral area, which is different from an external region CA1 of the peripheral area in which the fanout wires FLq−3 to FLq overlap the clock signal wires CL1 and CL2.

The overlapping of the fanout wires FLq−3 to FLq of the external region CA1 and the clock signal wires CL1 and CL2 will now be described with reference to FIG. 3.

Figure 3:
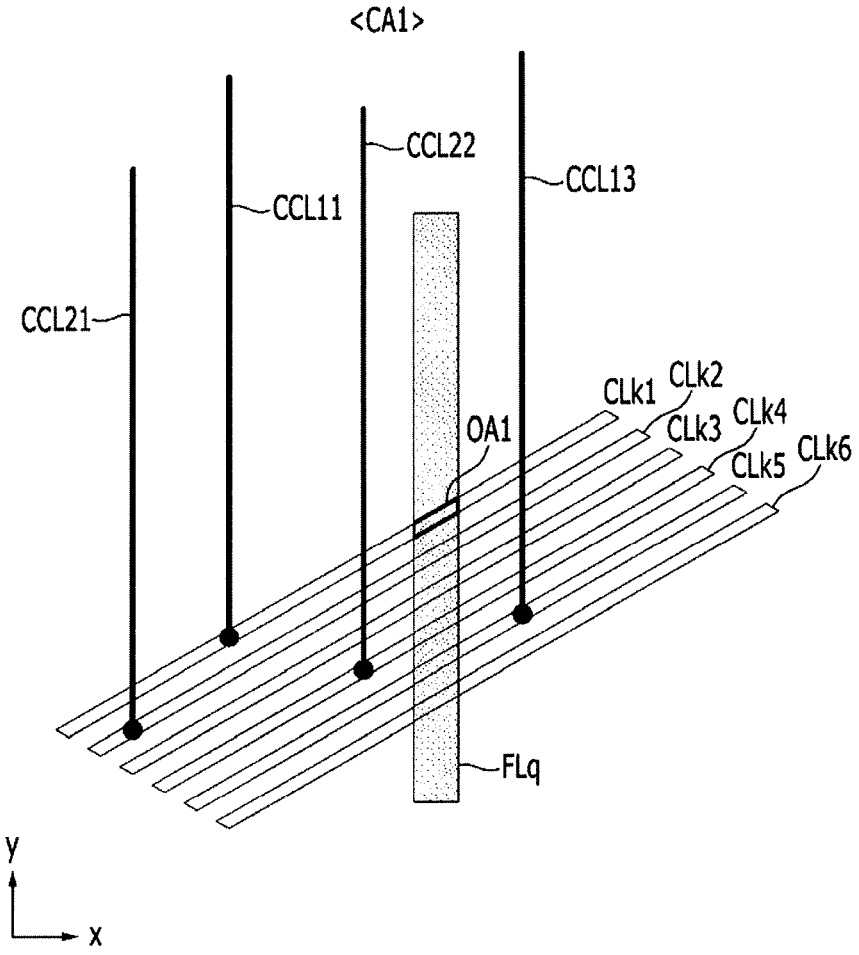
FIG. 3 shows clock signal wires and a fanout wire of a non-quadrangular display panel, according to an exemplary embodiment of the present invention.

FIG. 3 shows clock signal wires CLk1 to CLk6 and a fanout wire FLq of the non-quadrangular display panel 20, according to an exemplary embodiment of the present invention. The clock signal wires CLk1 to CLk6 are disposed to be inclined with a predetermined angle with respect to the y axis in the external region CA1 because the clock signal wires CLk1 to CLk6 are disposed in the peripheral area depending on the shape of the display area 30. It will be described in FIG. 3 that the clock signal wires CL1 and CL2 include first to sixth clock signal wires CLk1 to CLk6. Also, clock signal wire connecting lines CCL1 and CCL2 include clock signal wire connecting lines CCL11, CCL13, CCL21, and CCL22.

The first to sixth clock signal wires CLk1 to CLk6 are connected to the clock signal wire connecting lines CCL11, CCL13, CCL21, and CCL22 through contact holes for applying clock signals to the demultiplexer 40. The clock signal wire connecting lines CCL11, CCL13, CCL21, and CCL22 extend in the y-axis direction and are connected to the demultiplexer 40.

The fanout wire FLq extends in the y-axis direction. The fanout wire FLq overlaps at least one of the first to sixth clock signal wires CLk1 to CLk6. A shape of a region OA1 in which the first clock signal wire CLk1 overlaps the fanout wire FLq may include a parallelogram.

As shown in FIG. 2, the region in which the fanout wires FLk−1 to FLk+1 of the center region overlap the clock signal wires CL1 and CL2 includes a substantially rectangular shape. However, as shown in FIGS. 2 and 3, the region OA1 in which the fanout wires FLq−3 to FLq of the external region CA1 overlap the clock signal wires CL1 and CL2 is disposed to be a parallelogram.

A width of the fanout wires FLk−1 to FLk+1 of the center region corresponds to a width of the fanout wires FLq−3 to FLq of the external region CAL Further, a width of the clock signal wires CL1 and CL2 of the center region corresponds to a width of the clock signal wires CL1 and CL2 of the external region CAL Therefore, the area of the region OA1 overlapping in a parallelogram shape is greater than the area of the region overlapping in a rectangular shape.

Accordingly, a resistance and capacitance generated by overlapping one fanout wire, for example, the fanout wire FLk, and the clock signal wires CL1 and CL2 in the center region is generally less than a resistance and capacitance generated by overlapping one fanout wire, for example, the fanout wire FLq, and the clock signal wires CL1 and CL2 in the external region CA1.

Loads of the fanout wires FL1 to FLq connected to the demultiplexer 40 have different values depending on the region of the peripheral area in which they cross the clock signal wires CL1 and CL2. The driver IC 10 transmits a signal of the same intensity to the fanout wires FL1 to FLq but the intensity of the signal transmitted to the pixels PX is varied depending on the region of the peripheral area in which the fanout wires FL1 to FLq cross the clock signal wires CL1 and CL2.

A non-quadrangular display will now be described with reference to FIGS. 4 to 7, according to exemplary embodiments of the present invention.

Figure 4:
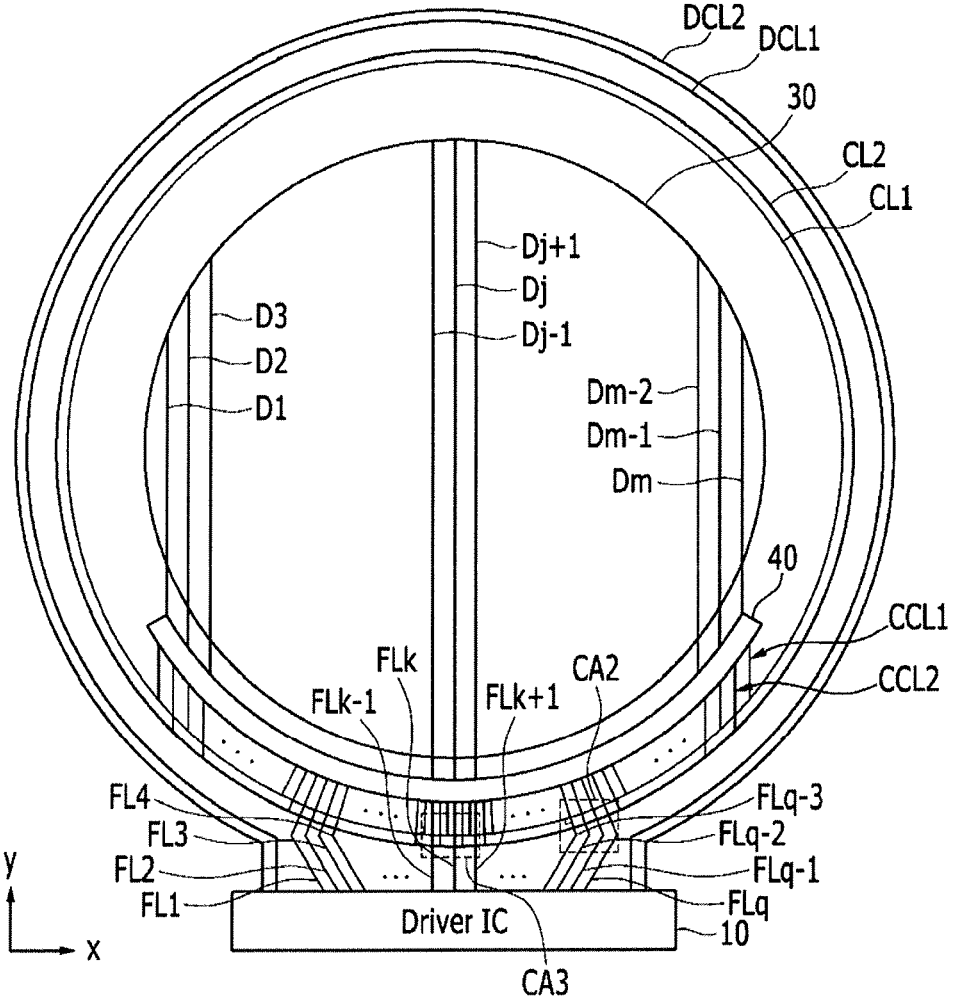
FIG. 4 shows part of a configuration of a non-quadrangular display panel, according to an exemplary embodiment of the present invention.

FIG. 4 shows part of a configuration of a non-quadrangular display panel, according to an exemplary embodiment of the present invention.

As shown in FIG. 4, the fanout wires FL1 to FLq of the non-quadrangular display panel 20, according to an exemplary embodiment of the present invention, are disposed with a slope (e.g., angle) corresponding to an alignment of the clock signal wires CL1 and CL2. The fanout wires FLk−1 to FLk+1 of a center region CA3 of the peripheral area, and the fanout wires FLq−3 to FLq of an external region CA2 of the peripheral area, may be disposed and inclined to be orthogonal to the clock signal wires CL1 and CL2.

Therefore, the fanout wires FLk−1 to FLk+1 of the center region CA3 and the fanout wires FLq−3 to FLq of the external region CA2 may be orthogonal to the clock signal wires CL1 and CL2 and overlap the clock signal wires CL1 and CL2. The overlapping between the fanout wires FLk−1 to FLk+1 of the center region CA3 with the clock signal wires CL1 and CL2 and the overlapping of the fanout wires FLq−3 to FLq of the external region CA2 with the clock signal wires CL1 and CL2 will be described with reference to FIGS. 5 and 6.

Figure 5:
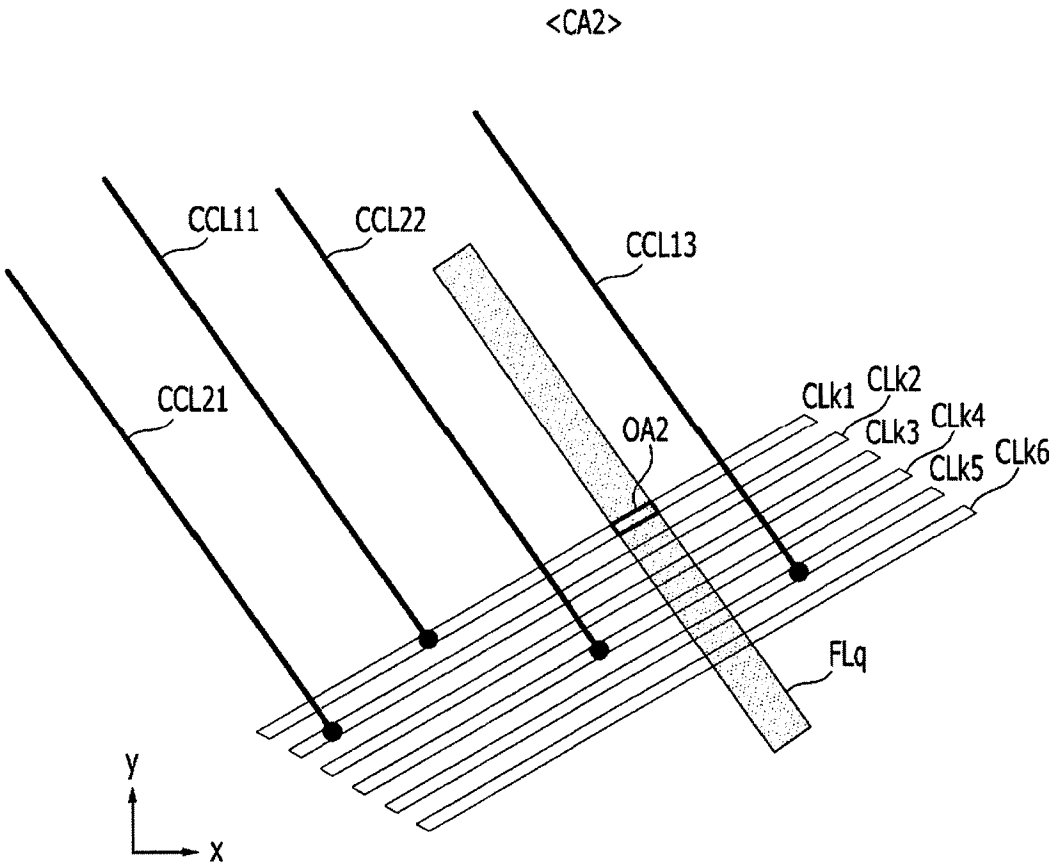
FIG. 5 shows clock signal wires and a fanout wire of a non-quadrangular display panel, according to an exemplary embodiment of the present invention.
Figure 6:
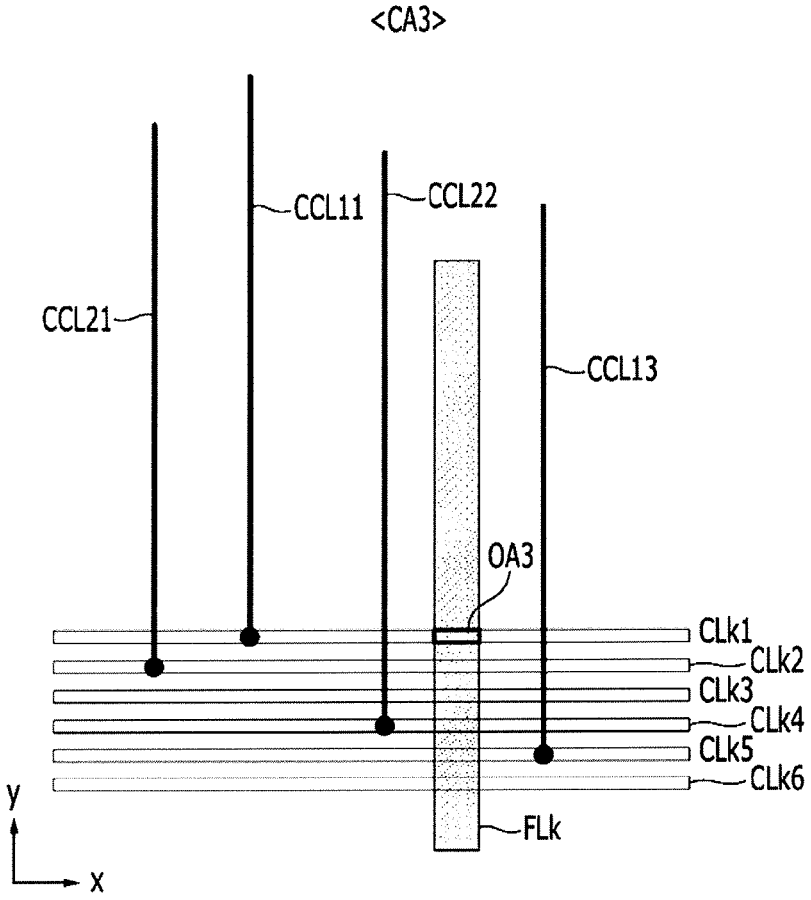
FIG. 6 shows clock signal wires and a fanout wire of a non-quadrangular display panel, according to an exemplary embodiment of the present invention.

FIG. 5 shows the first to sixth clock signal wires CLk1 to CLk6 and the fanout wire FLq of the non-quadrangular display panel 20, according to an exemplary embodiment of the present invention. FIG. 6 shows the first to sixth clock signal wires CLk1 to CLk6 and the fanout wire FLk of the non-quadrangular display panel 20, according to an exemplary embodiment of the present invention.

As shown in FIG. 5, the first to sixth clock signal wires CLk1 to CLk6 are disposed to be inclined with a predetermined angle with respect to the y axis in the external region CA2. In FIG. 5, the clock signal wires CL1 and CL2 will be described to include first to sixth clock signal wires CLk1 to CLk6.

The first to sixth clock signal wires CLk1 to CLk6 are connected to the clock signal wire connecting lines CCL11, CCL13, CCL21, and CCL22 for applying clock signals to the demultiplexer 40 through contact holes. The clock signal wire connecting lines CCL11, CCL13, CCL21, and CCL22 extend to be orthogonal to the first to sixth clock signal wires CLk1 to CLk6 and are connected to the demultiplexer 40.

The fanout wire FLq extends to be orthogonal to the first to sixth clock signal wires CLk1 to CLk6. The fanout wire FLq overlaps at least one of the first to sixth clock signal wires CLk1 to CLk6. A shape of the region OA2 in which the first clock signal wire CLk1 overlaps the fanout wire FLq is a rectangle or substantially rectangular. However, the shape of any region at which the fanout line FLq are overlapped with any of the first to sixth clock signal wires CLk1 to CLk6 is substantially rectangular. The fanout wire FLq was chosen as an exemplary line to illustrate the present inventive concept. However, the present invention is not limited thereto. For example, a region at which any of the fanout lines FLq−3 to FLq of the external region CA2 are overlapped with any of the first to sixth clock signal wires CLk1 to CLk6 is substantially rectangular.

As shown in FIG. 6, the first to sixth clock signal wires CLk1 to CLk6 are disposed to extend in the x-axis direction in the center region CA3. The first to sixth clock signal wires CLk1 to CLk6 are connected to the clock signal wire connecting lines CCL11, CCL13, CCL21, and CCL22 through contact holes for applying clock signals to the demultiplexer 40. The clock signal wire connecting lines CCL11, CCL13, CCL21, and CCL22 extend in the y-axis direction that is orthogonal to the first to sixth clock signal wires CLk1 to CLk6 and are connected to the demultiplexer 40.

The fanout wire FLk extends in the y-axis direction that is orthogonal to the first to sixth clock signal wires CLk1 to CLk6. A shape of the region OA3 in which the first clock signal wire CLk1 overlaps the fanout wire FLk is a rectangle or substantially rectangular. However, the shape of any region at which the fanout line FLk are overlapped with any of the first to sixth clock signal wires CLk1 to CLk6 is substantially rectangular. The fanout wire FLk was chosen as an exemplary line to illustrate the present inventive concept. However, the present invention is not limited thereto. For example, a region at which any of the fanout lines FLk−1 to FLk+1 of the center region CA3 are overlapped with any of the first to sixth clock signal wires CLk1 to CLk6 is substantially rectangular.

The regions formed by the overlapping of the fanout wires FLq−3 to FLq with the first to sixth clock signal wires CLk1 to CLk6 in the external region CA2, as shown in FIG. 5, and the regions formed by the overlapping of the fanout wires FLk−1 to FLk+1 with the first to sixth clock signal wires CLk1 to CLk6 in the center region CA3, as shown in FIG. 6, are substantially rectangular. In addition, a width of the fanout wires FLk−1 to FLk+1 of the center region CA3 corresponds to a width of the fanout wires FLq−3 to FLq of the external region CA2. A width of the first to sixth clock signal wires CLk1 to CLk6 of the center region CA3 corresponds to a width of the first to sixth clock signal wires CLk1 to CLk6 of the external region CA2. Therefore, an area of the overlapping region OA3 in the center region CA3 is substantially the same as an area of the overlapping region OA2 in the external region CA2.

Accordingly, a resistance and capacitance generated by overlapping one fanout wire, for example, the fanout wire FLk, and the first to sixth clock signal wires CLk1 to CLk6 in the center region CA3 of the peripheral area is substantially the same as a resistance and capacitance generated by overlapping one fanout wire, for example, the fanout wire FLq and the first to sixth clock signal wires CLk1 to CLk6 in the external region CA2 of the peripheral area.

Loads of the fanout wires FL1 to FLq connected to the demultiplexer 40 may have a same value in the center region CA3 or the external region CA2. Accordingly, when the driver IC 10 supplies signals with a same intensity to the fanout wires FL1 to FLq, the signals passed to the pixels PX through the demultiplexer 40 may have the same intensity.

A non-quadrangular display panel will now be described with reference to FIG. 7, according to an exemplary embodiment of the present invention.

Figure 7:
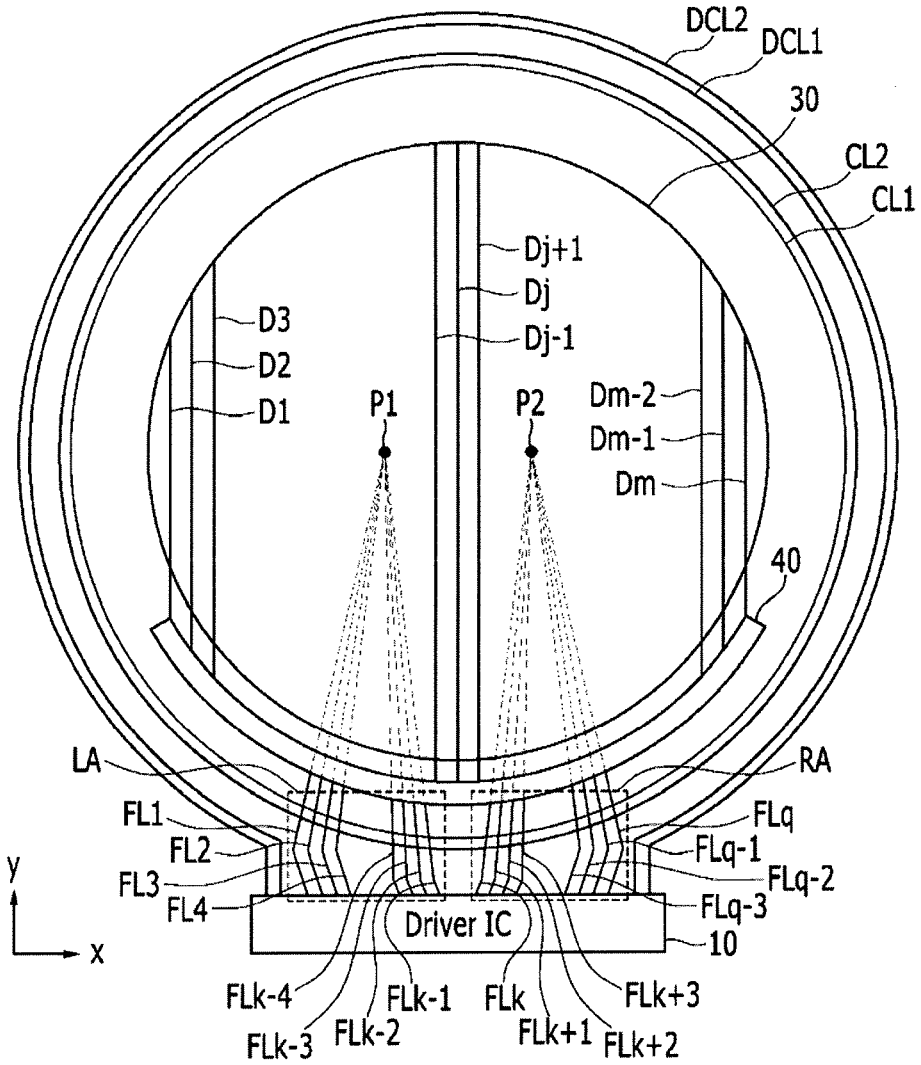
FIG. 7 shows part of a configuration of a non-quadrangular display panel, according to an exemplary embodiment of the present invention.

FIG. 7 shows part of a configuration of a non-quadrangular display panel, according to an exemplary embodiment of the present invention.

As shown in FIG. 7, the fanout wires FL1 to FLq of a non-quadrangular display panel, according to an exemplary embodiment of the present invention, are disposed with an angle with respect to the clock signal wires CL1 and CL2 on the right and the left with respect to a center of a region of the peripheral area where the fanout wires FL1 to FLq are disposed. The fanout wires FL1 to FLk−1 in a left area LA of the peripheral area are inclined to be substantially orthogonal to the clock signal wires CL1 and CL2 and are disposed with angles so that imaginary lines extending from the fanout wires FL1 to FLk−1 may gather (e.g., meet) at a first point P1 of the display area 30. The fanout wires FLk to FLq in a right area RA of the peripheral area are inclined to be substantially orthogonal to the clock signal wires CL1 and CL2 and are disposed with angles so that imaginary lines extending from the fanout wires FLk to FLq may gather at a second point P2 of the display area 30.

When a size of an acute angle formed when a fanout wire, for example, the fanout wire FL1, crosses the clock signal wires CL1 and CL2 is "A" and a size of an acute angle formed when a (k−1)-th fanout wire, for example, the fanout wire FLk−1, crosses the clock signal wires CL1 and CL2 is "B", "A" is not equal to "B".

However, a difference between "A" and "B", according to an exemplary embodiment of the present invention, is less than a difference between an acute angle formed when the fanout wire FL1 crosses the clock signal wires CL1 and CL2 and an acute angle formed when the (k−1)-th fanout wire FLk−1 crosses the clock signal wires CL1 and CL2 as shown in FIG. 2. Therefore, regarding the fanout wires FL1 to FLq in to FIG. 7, according to an exemplary embodiment of the present invention, a deviation of the areas of the regions in which the fanout wires FL1 to FLq cross the clock signal wires CL1 and CL2 is reduced when compared to the deviation of the areas of the regions in which the fanout wires FL1 to FLq cross the clock signal wires CL1 and CL2 in FIG. 2.

The present invention is applicable to any kind of non-quadrangular display panels. The fanout wires FL1 to FLq for applying a signal to the demultiplexer 40 have been exemplarily described with reference to the above-noted drawings. The present invention is applicable to designing fanout wires for applying signals to driving circuits (e.g., a scan driver) for transmitting signals to pixels PX and overlapping the clock signal wires CL1 and CL2.

The above-noted drawings do not describe that a portion of the display panel 20 may include a convex curve and a concave curve. However, when the display panel 20 includes the convex curve and the concave curve, the fanout wires FL1 to FLq may be disposed to cross the clock signal wires CL1 and CL2 perpendicularly or substantially perpendicularly.

The present disclosure relates to a non-quadrangular display panel having substantially the same loads formed on wires for supplying a signal to a pixel PX and having reduced deviation of a data signal supplied to a pixel PX.

While the inventive concept has been particularly shown and described with reference to exemplary embodiments thereof, it will be apparent to those of ordinary skill in the art that various changes in form and detail may be made therein without departing from the spirit and scope of the inventive concept as defined by the following claims.

What is claimed is:

1. A non-quadrangular display panel comprising:

a plurality of data lines disposed in a non-quadrangular display area, wherein the non-quadrangular display area includes a plurality of pixels;

a demultiplexer disposed in a peripheral area of the non-quadrangular display panel, wherein the peripheral area is disposed adjacent to the non-quadrangular display area, and wherein the demultiplexer passes a data signal to at least one of the plurality of data lines;

a plurality of clock signal lines disposed in the peripheral area, wherein at least two adjacent clock signal lines are uniformly spaced apart from each other, and wherein the plurality of clock signal lines transmit clock signals at different times to the demultiplexer;

a plurality of fanout wirings disposed in the peripheral area orthogonal to the plurality of clock signal lines and connected to the demultiplexer; and a driver integrated circuit (IC) connected to the plurality of fanout wirings, and generating the data signal passed to the at least one of the plurality of data lines, wherein the plurality of fanout wirings is disposed between the demultiplexer and the driver integrated circuit (IC), and wherein each of the plurality of fanout wirings crosses each of the plurality of clock signal lines.

2. The non-quadrangular display panel of claim 1, wherein the non-quadrangular display area is circular.

3. The non-quadrangular display panel of claim 1, wherein the plurality of data lines and the plurality of fanout wirings are disposed on a first layer.

4. The non-quadrangular display panel of claim 3, wherein the plurality of clock signal lines are disposed on a second layer.

5. The non-quadrangular display panel of claim 4, wherein an insulating layer is disposed between the first and second layers.

6. The non-quadrangular display panel of claim 1, wherein the demultiplexer includes a switching element including input terminals connected to the plurality of fanout wirings, output terminals connected to the plurality of data lines, and gate terminals connected to the plurality of clock signal lines.

7. The non-quadrangular display panel of claim 1, wherein a first area of a first region in which a clock signal line of the plurality of clock signal lines overlaps with a fanout wiring of the plurality of fanout wirings is substantially equal to a second area of a second region in which the dock signal line of the plurality of clock signal lines overlaps with another fallout wiring of the plurality of fanout wirings.

8. The non-quadrangular display panel of claim 1, wherein imaginary lines extending from the plurality of fanout wirings meet at a point in the non-quadrangular display area.

9. A non-quadrangular display panel comprising:

a plurality of data lines disposed in a non-quadrangular display area;

a plurality of clock signal lines that are curved and disposed in a peripheral area, wherein the peripheral area is disposed adjacent to the non-quadrangular display area, and wherein at least two adjacent clock signal lines of the plurality of clock signal lines are uniformly spaced apart from each other; and a plurality fanout wirings disposed in the peripheral area, wherein each fanout wiring of the plurality of fanout wirings crosses each of the plurality of clock signal lines at a perpendicular angle, and a driver integrated circuit (IC) connected to the plurality of fanout wirings, and generating the signal passed to a first pixel, wherein the plurality of data lines, the plurality of clock signal lines, and the plurality of fanout wiring are connected to a demultiplexer, wherein the demultiplexer passes a data signal from one of the plurality of fanout wirings to the first pixel through a data line of plurality of data lines, and wherein the plurality of fanout wirings is disposed between the demultiplexer and the driver integrated circuit (IC).

10. The non-quadrangular display panel of claim 9, wherein the plurality of clock signal lines are circular.

11. The non-quadrangular display panel of claim 9, wherein the plurality of clock signal lines are oval.

12. The non-quadrangular display panel of claim 9, wherein the plurality of clock signal lines include a concave portion and a convex portion.

13. The non-quadrangular display panel of claim 9, wherein the plurality of data lines and the plurality of fanout wirings are disposed on a first layer.

14. The non-quadrangular display panel of claim 13, wherein the plurality of clock signal lines are disposed on a second layer.

15. The non-quadrangular display panel of claim 14, wherein an insulating layer is disposed between the first and second layers.

16. The non-quadrangular display panel of claim 9, wherein the demultiplexer includes a first switching element, wherein the first switching element includes input terminals connected to the plurality of fanout wirings, output terminals connected to the plurality of data lines, and gate terminals connected to the plurality of clock signal lines.

17. The non-quadrangular display panel of claim 9, wherein a first overlap area between one of fanout wirings and one of the clock signal lines is substantially equal to a second overlap area between another fanout wirings and the one of the clock signal lines.

18. A non-quadrangular display panel comprising:

a plurality of data lines disposed in a non-quadrangular display area;

a plurality of clock signal lines that are curved and disposed in a peripheral area, wherein the peripheral area is disposed adjacent to the non-quadrangular display area, and wherein at least two adjacent clock signal lines of the plurality of clock signal lines are uniformly spaced apart from each other; and a plurality of fanout wirings disposed in the peripheral area, wherein each of the plurality of fanout wirings cross each of the plurality of clock signal lines substantially orthogonally, and a driver integrated circuit (IC) connected to the plurality of fanout wirings, and generating the signal passed to a first pixel, wherein the plurality of data lines, the plurality of clock signal lines, and the plurality of fanout wirings are connected to a demultiplexer, wherein the demultiplexer passes a signal from one of the plurality of fanout wirings to a first pixel through the data line of plurality of data lines, wherein the plurality of fanout wirings is disposed between the demultiplexer and the driver integrated circuit (IC), and wherein imaginary lines extending from the plurality of fanout wirings meet at a point in the non-quadrangular display area.

* * * * *